US009005399B2

(12) United States Patent
Breuer et al.

(10) Patent No.: US 9,005,399 B2
(45) Date of Patent: Apr. 14, 2015

(54) PIN SEAMED PRESS FELT WITH TRIPLE LAYER BASE FABRIC

(71) Applicant: Huyck Licensco, Inc., Raleigh, NC (US)

(72) Inventors: Hans-Peter Breuer, Zell (DE); Friedrich Postl, Flatz (AT)

(73) Assignee: Huyck Licensco, Inc., Youngsville, NC (US)

( * ) Notice: Subject to any disclaimer, the term of this patent is extended or adjusted under 35 U.S.C. 154(b) by 0 days.

(21) Appl. No.: 14/075,673

(22) Filed: Nov. 8, 2013

(65) Prior Publication Data

US 2014/0190645 A1 Jul. 10, 2014

Related U.S. Application Data

(60) Provisional application No. 61/750,953, filed on Jan. 10, 2013, provisional application No. 61/752,161, filed on Jan. 14, 2013.

(51) Int. Cl.
*D21F 3/00* (2006.01)
*D21F 1/00* (2006.01)
*D21F 7/10* (2006.01)

(52) U.S. Cl.
CPC ..... *D21F 1/0036* (2013.01); *D21F 7/10* (2013.01)

(58) Field of Classification Search
USPC ..... 162/358.2, 358.1, 348, 900, 903, 904
See application file for complete search history.

(56) References Cited

U.S. PATENT DOCUMENTS 4,601,785 A 7/1986 Lilja et al.
4,737,241 A 4/1988 Gulya
4,764,417 A 8/1988 Gulya
4,824,525 A * 4/1989 Penven ..... 162/358.2
4,887,648 A 12/1989 Cunnane
4,892,781 A * 1/1990 Penven ..... 442/189
5,476,123 A 12/1995 Rydin
7,135,093 B2 11/2006 Gstrein
7,493,923 B2 * 2/2009 Barrett et al. ..... 139/383 A
2004/0026057 A1 * 2/2004 Watanabe et al. ..... 162/348
2008/0135200 A1 * 6/2008 Harwood ..... 162/358.2
2008/0230199 A1 * 9/2008 Harwood ..... 162/358.2

(Continued)

FOREIGN PATENT DOCUMENTS

JP 2001254287 9/2001
JP 2003155685 5/2003
WO WO-0017433 * 3/2000 ..... D03D 3/04

OTHER PUBLICATIONS

JP20011254287, Sugiyama Hiroyuki, machine translation, Sep. 2001.*
International Search Report and Written Opinion for corresponding PCT Application No. PCT/US2013/074237, date of mailing Feb. 13, 2014.

(Continued)

*Primary Examiner* — Mark Halpern
(74) *Attorney, Agent, or Firm* — Myers Bigel Sibley & Sajovec, P.A.

(57) ABSTRACT

A press felt includes: a base fabric comprising a plurality of repeat units, each of the repeat units comprising a plurality of exterior machine direction (MD) yarns, each of which includes an upper run and a lower run merging with seam loops at each end, a plurality of middle MD yarns positioned between the upper and lower runs of the exterior MD yarns, a plurality of cross machine direction (CMD) yarns interwoven with the exterior MD yarns and the middle MD yarns in a predetermined regular weave pattern, the seam loops defining the longitudinal ends of the press felt; and a batt layer overlying the base fabric.

14 Claims, 4 Drawing Sheets

(56) References Cited

U.S. PATENT DOCUMENTS

2010/0314065 A1* 12/2010 Takamura ..... 162/358.2
2011/0030909 A1* 2/2011 Danby et al. ..... 162/358.2
2011/0186256 A1* 8/2011 Mikkonen et al. ..... 162/358.2

* cited by examiner

PIN SEAMED PRESS FELT WITH TRIPLE LAYER BASE FABRIC

RELATED APPLICATIONS

This application claims priority from and the benefit of U.S. Provisional Patent Application Nos. 61/750,953, filed Jan. 10, 2013 and 61/752,161, filed Jan. 14, 2013, the disclosures of which are hereby incorporated herein in their entireties.

FIELD OF THE INVENTION

The present invention relates generally to papermaking, and more particularly to fabrics used in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a dryer section for further moisture removal. After drying, the paper is ready for secondary processing and packaging.

Press felts typically include one or more base fabric layers; these can be "flat-woven" and formed after weaving into an endless belt, or can be woven in endless form.

Of course, weaving a fabric of a base layer requires that provision be made for joining it into endless belts. Such joints should be constructed in such a manner that they are sufficiently strong to withstand the extreme load, temperature, and wear conditions the press felt experiences, yet do not cause the surface of the press felt above the seam to unduly mark the paper. One popular method of joining the base fabric of a press felt is to form loops with machine direction yarns on each end of the base fabric. To form the base fabric into an endless belt, the ends of the fabric are placed adjacent to each other, with each of the loops on one end positioned between two loops on the other end in interdigitating fashion. A "pin" (usually formed of a single monofilament or monofilament strands) is then inserted into all of the loops to join the ends. After the batt layer(s) are needled or otherwise attached to the base layer, the batt layer(s) are cut at the seam location, the pin is removed, and the finished press felt is shipped to a paper mill. Once at the paper mill, the press felt can be installed by placing it onto a paper machine, then inserting another (usually more flexible) monofilament pin or pintle into the loops. Examples of this type of seam are described in U.S. Pat. Nos. 4,764,417 and 4,737,241 to Gulya; U.S. Pat. No. 4,601,785 to Lilja et al.; U.S. Pat. No. 5,476,123 to Rydin, and U.S. Pat. No. 7,135,093 to Gstrein, the disclosures of which are hereby incorporated herein by reference in their entireties.

Base fabrics of press felts have taken a variety of configurations. In one configuration, the "fabric" is actually two separate fabrics that form a total of three layers. The bottom fabric is a double layer fabric that provides the seam loops, with the top fabric being a single layer fabric that is cut after weaving, combination with the bottom fabric, and needling of an overlying batt layer. An exemplary press felt of this configuration is shown in International Patent Application No. WO 0017433, the disclosure of which is hereby incorporated herein in its entirety. One apparent disadvantage of a fabric of this configuration is the need to cut the top fabric layer, which then has loose ends that can impact the manner in which the overlying batt lays over the fabric.

SUMMARY OF THE INVENTION

In one aspect, embodiments of the invention are directed to a press felt. The press felt comprises a base fabric comprising a plurality of repeat units. Each of the repeat units comprises a plurality of exterior machine direction (MD) yarns, each of which includes an upper run and a lower run merging with seam loops at each end, a plurality of middle MD yarns positioned between the upper and lower runs of the exterior MD yarns, and a plurality of cross machine direction (CMD) yarns interwoven with the exterior MD yarns and the middle MD yarns in a predetermined regular weave pattern, the seam loops defining the longitudinal ends of the press felt. The press felt also comprises a batt layer overlying the base fabric. The resulting press felt provide the advantages enjoyed by three layers of base fabric without the disadvantages suffered by cutting through a top single layer as in prior fabrics.

BRIEF DESCRIPTION OF THE FIGURES

FIG. 4A is a weaving diagram, wherein each "X" represents an interweaving location in which the CMD yarn passes over the corresponding MD yarn. FIG. 4B is a schematic section view taken parallel to the cross-machine direction.

DETAILED DESCRIPTION OF EMBODIMENTS OF THE PRESENT INVENTION

Figure 1:
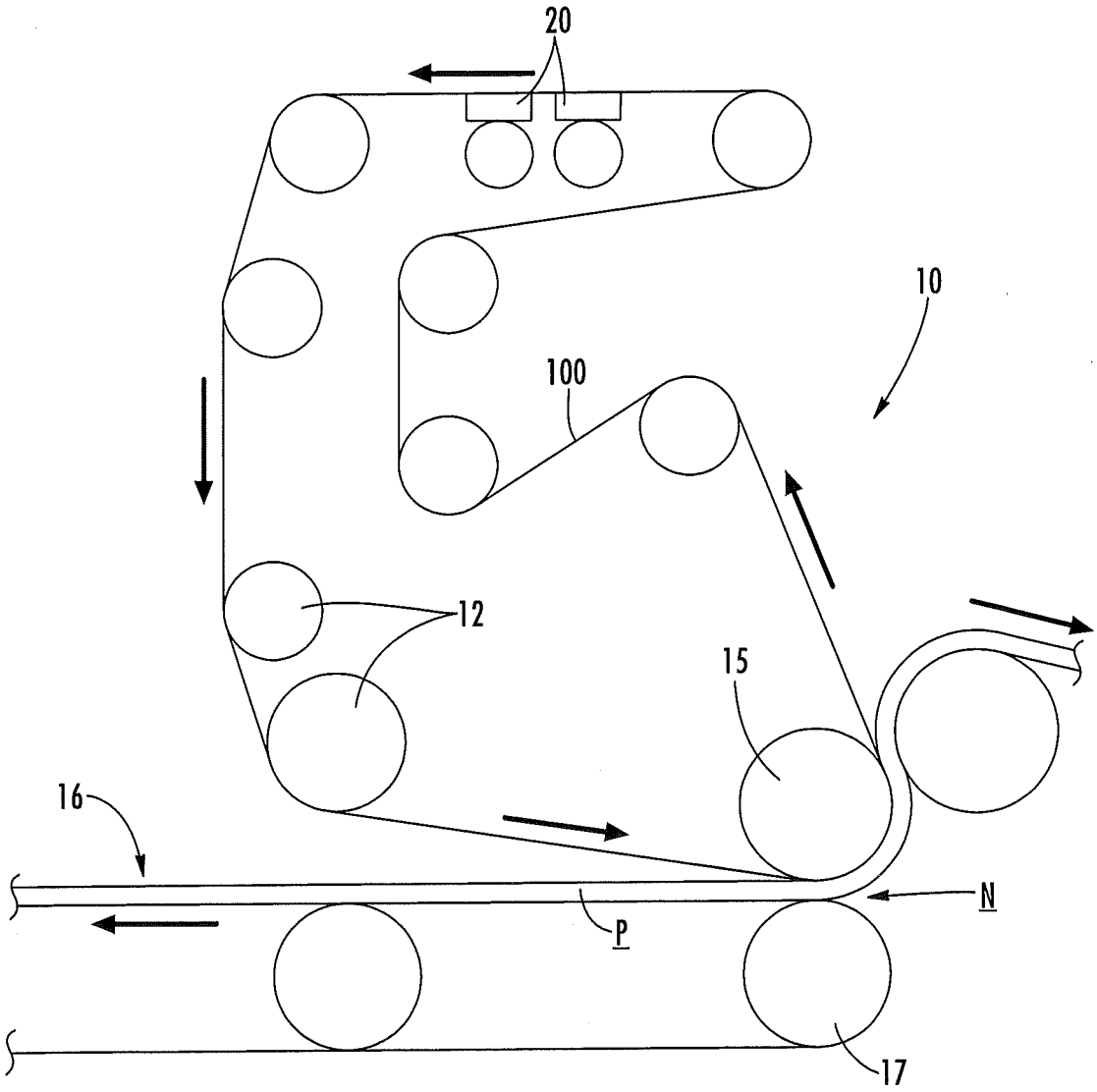
FIG. 1 is a schematic diagram illustrating the press section of a papermaking machine that may employ a press felt according to embodiments of the present invention.
Figure 2:
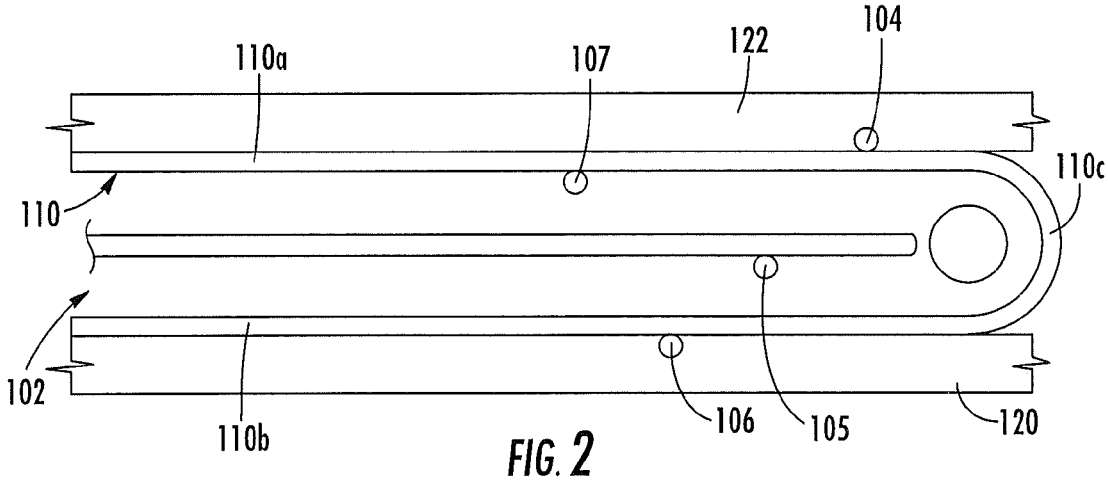
FIG. 2 is an enlarged, partial, cutaway side view of the press felt of FIG. 1 showing the pin seam of the press felt of FIG. 1.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

As used herein, the terms "machine direction" (MD) and "cross machine direction" (CMD) refer, respectively, to a direction aligned with the direction of travel of the papermakers' fabric on a papermaking machine, and a direction parallel to the fabric surface and transverse to the direction of travel. Also, both the flat weaving and endless weaving methods described hereinabove are well known in the art, and the term "endless belt" as used herein refers to belts made by either method.

Referring now to the drawings, a papermaking machine press section, designated broadly at 10, is illustrated in FIG. 1. The press section 10 includes a press felt 100 that is installed upon and conveyed by a set of rollers 12. In its travel, the felt 100 travels over a press roll 15. An opposed press roll 17 is positioned so that, in conjunction with the felt 100 and press roll 15, it forms a nip N between the press rolls 15.

In operation, a paper web P is conveyed from a forming section 16 through the nip N formed by the press rollers 15, 17, wherein pressure is applied to the paper web P by the press rolls 15, 17. The pressure forces moisture from the paper web P that is absorbed by the felt 100. As the felt 100 is conveyed around its roller set 12, moisture is removed therefrom, and the felt 100 is conditioned by one or more suction boxes 20.

FIGS. 2, 3, 4A and 4B illustrate enlarged sections of the felt 100. As can be seen in the aforementioned figures, the felt 100 includes a base fabric 102 which includes repeat units that comprise a set of four exterior MD yarns 110-113, a set of two middle MD yarns 115, 116, and four CMD yarns 104-107 interwoven in a regular pattern with the exterior MD yarns 110-113 and middle MD yarns 115, 116.

Figure 3:
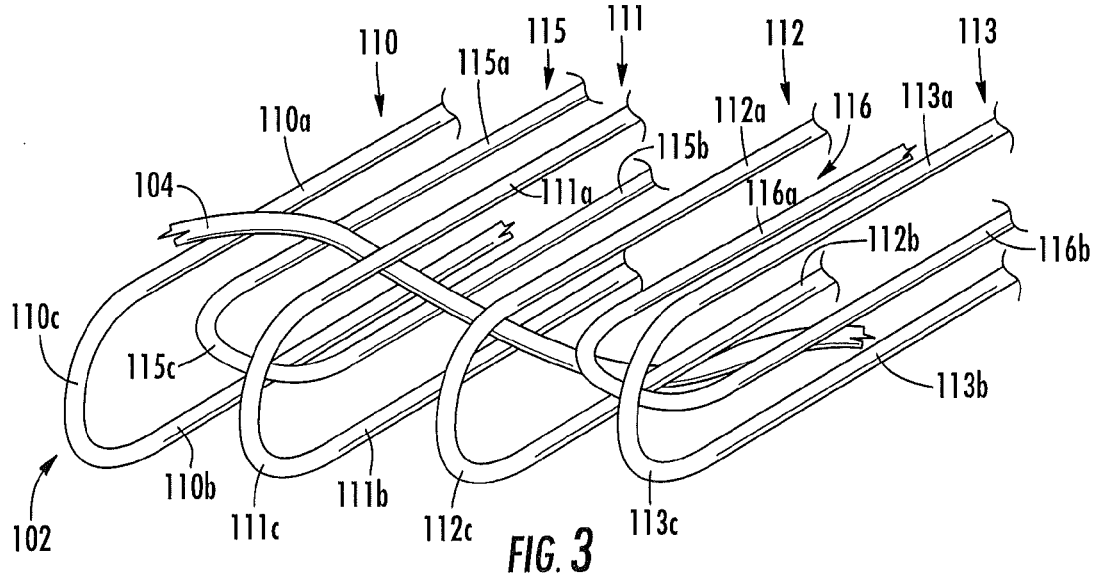
FIG. 3 is an enlarged, partial, perspective view of the seam area of the base fabric of the press felt of FIG. 1.
Figure 4A:
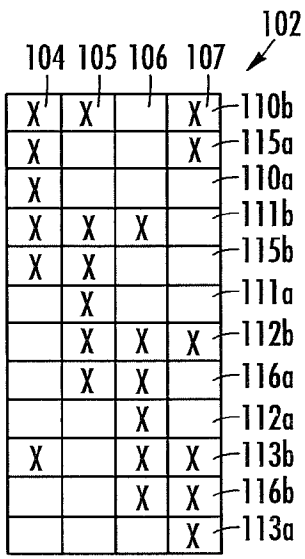
FIGS. 4A and 4B are schematic representations of a repeat unit of the base fabric of the press felt of FIG. 1.
Figure 4B:
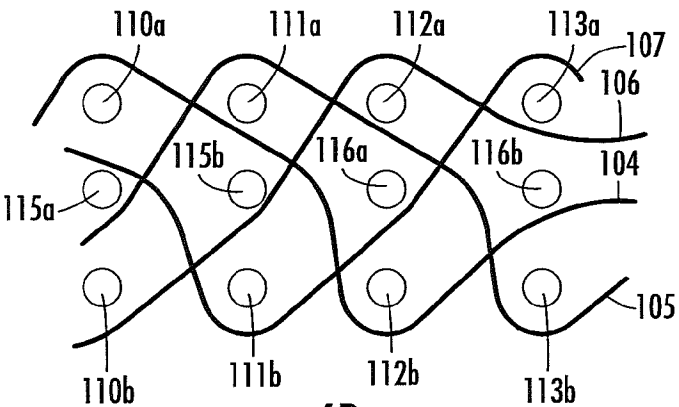

As can be seen in FIGS. 3, 4A and 4B, each of the exterior MD yarns 110-113 includes a corresponding upper run 110*a*, 113*a*, a corresponding lower run 110*b*, 113*b*, and a corresponding loop 110*c*, 113*c* that joins each upper run 110*a*, 113*a* to its corresponding lower run 110*b*, 113*b*. Each of the center MD yarns 115, 116 includes two runs (115*a*, 115*b* and 116*a*, 116*b*) that is disposed between the upper and lower runs 110*a*, 110*b*-113*a*, 113*b* of one of the exterior MD yarns 110-113. The runs 115*a*, 115*b* are connected by a loop 115*c*, and the runs 116*a*, 116*b* are connected by a loop 116*c*.

Referring still to FIGS. 3, 4A and 4B, each of the CMD yarns 104-107 interweaves with the MD yarns in the following manner. The CMD yarn passes over an upper run of an exterior MD yarn, passes under the upper run of the adjacent exterior MD yarn but above the run of the middle yarn directly below, passes under the lower run of the next adjacent exterior MD yarn, then passes above the upper run of the next exterior MD yarn but below the corresponding run of the middle MD yarn. As an example, CMD yarn 104 passes over upper run 110*a*, between upper run 111*a* and run 115*b* of middle yarn 115, below lower run 112*b*, and between lower run 113*b* and run 116*b* of middle yarn 116. Each of the other CMD yarns 105-107 follow a similar pattern, but are offset to pass over a different upper run of an exterior MD yarn: thus, CMD yarn 105 passes over upper run 111*a*, CMD yarn 106 passes over upper run 112*a*, and CMD yarn 107 passes over upper run 113*a*. This weaving sequence is followed in other repeat units to form an entire base fabric 102.

Figure 8:
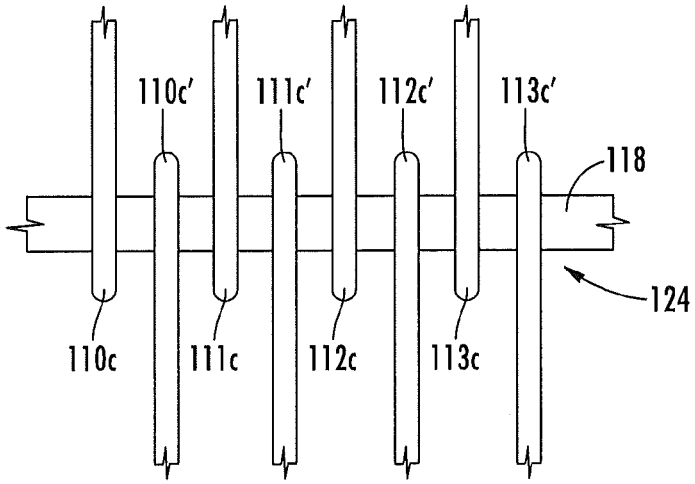
FIG. 8 is a top view of the seam area of the press felt of FIG. 1.

The base fabric 102 is woven in a flat weave process; thus, in a flat condition, the fabric 102 has two free ends, one of which includes seam loops 110*c*-113*c* formed by exterior MD yarns 110-113 at one end, and the other of which includes seam loops 110*c*'-113*c*' formed by the opposite ends of the exterior MD yarns 110-113. When the base fabric 102 is in an endless condition such as that illustrated in FIG. 8, the loops 110*c*-113*c* and 110*c*'-113*c*' are positioned in interdigitated fashion, and a pintle 118 is inserted through the loops 110*c*-113*c*, 110*c*'-113*c*' to join the ends of the base fabric 102 to form a seam 124. The resulting endless felt 100 can then be employed on a papermaking machine.

Those skilled in this art will recognize that other types of weaves can be employed in the base fabric 102 of the press felt 100. FIGS. 5A-7B illustrate, respectively, fabrics 200, 300, and 400, each of which have slightly different weave patterns. As shown in FIGS. 6A and 6B, each CMD yarn 202 in fabric 200 follows the same weaving sequence as the CMD yarns of the fabric 102, but the offsets of the CMD yarns 202-209 are different, such that the first and third CMD yarns 202, 204 of the repeat unit pass over and under the same upper and lower runs 210*a*,210*b*-213*a*,213*b* of the same exterior MD yarns 210-213 and the same runs 215*a*, 215*b*, 216*a*, 216*b* of the same middle MD yarns 215-216, the second and fourth CMD yarns 203, 205 pass over the same runs of the same MD yarns, the fifth and seventh CMD yarns 206, 208 pass over the same runs of the same MD yarns, and the sixth and eighth CMD yarns 207, 209 pass over the same runs of the same MD yarns. The result is a repeat unit that has eight CMD yarns 202-209 rather than four (as is the case with the fabric 102).

Figure 5A:
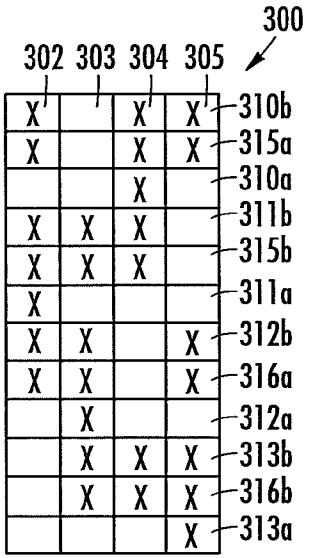
FIGS. 5A and 5B are schematic representations of a repeat unit of a base fabric according to alternative embodiments of the invention.
Figure 5B:
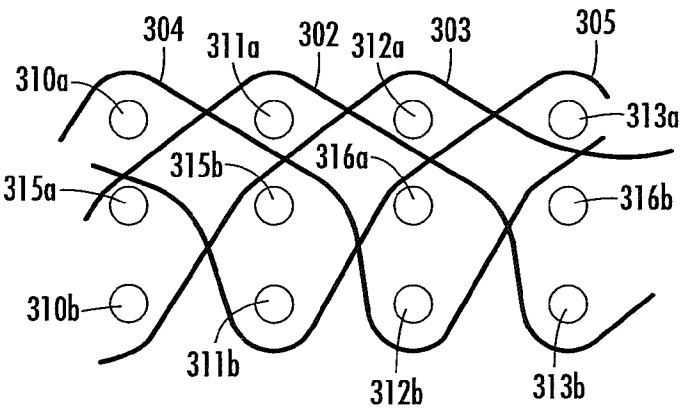
Figure 6A:
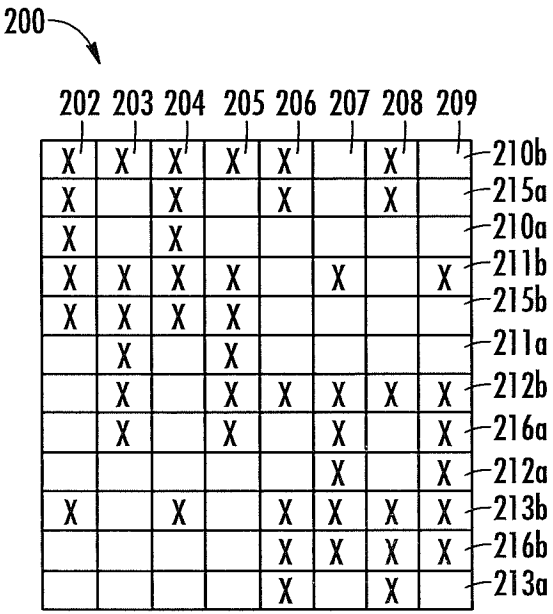
FIGS. 6A and 6B are schematic representations of a repeat unit of a base fabric according to alternative embodiments of the invention.
Figure 6B:
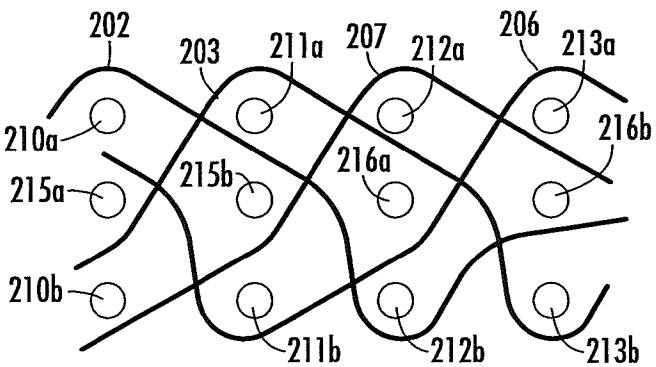
Figure 7A:
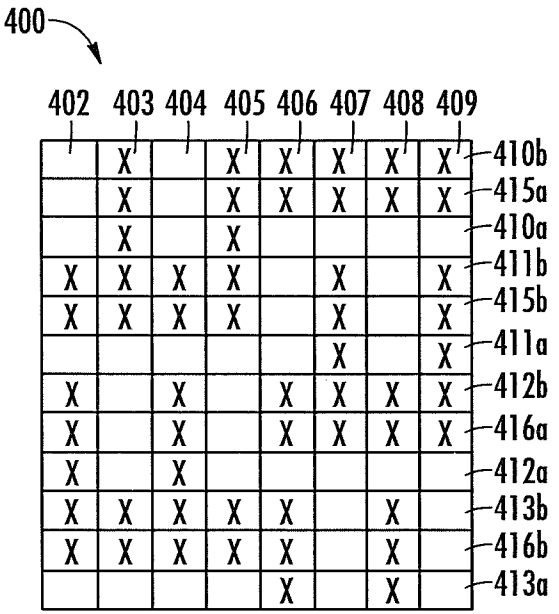
FIGS. 7A and 7B are schematic representations of a repeat unit of a base fabric according to alternative embodiments of the invention.
Figure 7B:
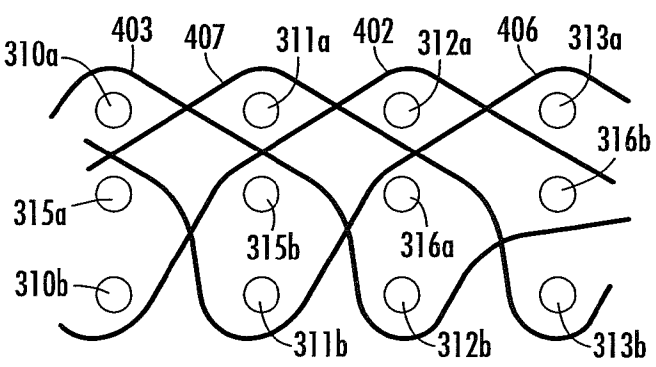

Referring now to FIGS. 5A and 5B, the repeat unit of the fabric 300 includes four CMD yarns 302-305 that interweave with four exterior MD yarns 310-313 (each of which has upper and lower runs 310*a*, 310*b*-313*a*, 313*b*) and two middle MD yarns 315, 316 (each of which has runs 315*a*, 315*b*, 316*a*, 316*b*). Each CMD yarn 310-313 passes over the upper run of an exterior MD yarn, between the upper run of the adjacent exterior MD yarn and the run of the middle MD yarn directly below, below the lower run of the next adjacent exterior MD yarn, and between the upper run of the next adjacent exterior MD yarn and the run of the middle MD yarn directly below. The CMD yarns 304-307 are offset from each other by one MD yarn. As shown in FIGS. 7A and 7B, the fabric 400 includes eight CMD yarns 402-409 that follow the same weaving sequence as the MD yarns 304-307 of the fabric 300, but like the fabric 200 the CMD yarns 402-409 of the fabric 400 are offset such that the CMD yarns 402, 404 pass over the same upper and lower runs 410*a*, 410*b*-413*a*, 413*b* of the same exterior MD yarns 410-413 and the same runs 415*a*, 415*b*-416*a*, 416*b* of the same middle MD yarns 415, 416, the CMD yarns 403, 405 pass over the same runs of the same MD yarns, the CMD yarns 406, 408 pass over the same runs of the same MD yarns, and the CMD yarns 407, 409 pass over the same runs of the same MD yarns.

Those skilled in this art will understand that other numbers of MD and/or CMD yarns may be employed. For example, a repeat unit may include six CMD yarns rather than four or eight as shown.

Yarn sizes may vary with the desired properties of the press felt. Typical yarn diameters include exterior MD yarns of between about 0.2 mm and 0.7 mm, middle MD yarns of between about 0.2 mm and 0.7 mm, and CMD yarns of between about 0.2 mm and 0.7 mm. In each instance, yarns sized at 0.2 mm to 0.5 mm may be particularly suitable.

With respect to any of the illustrated or described embodiments, the press felt of the invention may also include one or more batt layers. Referring back to FIG. 2, the press felt 100 includes two batt layers: a machine side batt layer 120 and a paper side batt layer 122. Illustratively and preferably, these batt layers 120, 122 are attached to the base fabric layer 22 through a needling process, although other attachment techniques, such as heat bonding and adhesives, can also be used with the present invention. The machine side and paper side batt layers 120, 122 should be formed of material, such as a synthetic fiber like acrylic, aramid, polyester, or nylon, or a natural fiber such as wool, that assists in wicking water away from the base fabric layer 102. Preferred materials for the batt layers 120, 122 include polyamide, polyester and blends thereof. The weight and thickness of the batt layers 120, 122 can vary, although it is preferably that the ratio of batt weight to fabric weight is about between about 0.5 and 2.0, with 1.0 being more preferred. Also, in some embodiments, it may be desirable to have additional batt layers or to omit either or both of the batt layers 120, 122.

Press felts according to embodiments of the invention may have the advantage of including a triple layer base fabric that can be assembled with a pin seam without the need to cut through the top fabric layer as was typically the case with prior fabrics. As such, the seam area may have greater life as the flap over the seam wears over time.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A press felt, comprising:

(a) a base fabric comprising a plurality of repeat units, each of the repeat units comprising a plurality of exterior machine direction (MD) yarns, each of which includes an upper run and a lower run merging with seam loops at each end, a plurality of middle MD yarns positioned between the upper and lower runs of the exterior MD yarns, wherein the plurality of middle MD yarns comprises half the number of the plurality of exterior MD yarns, and a plurality of cross machine direction (CMD) yarns interwoven with the exterior MD yarns and the middle MD yarns in a predetermined regular weave pattern, the seam loops defining the longitudinal ends of the press felt, wherein a CMD yarn nearest the seam loops interweaves with the upper and lower runs of the exterior MD yarns and with the middle MD yarns; and (b) a batt layer overlying the base fabric.

2. The press felt defined in claim 1, wherein each of the middle MD yarns has two generally parallel runs connected by a loop.

3. The press felt defined in claim 2, wherein at least one of the CMD yarns in the repeat unit interweaves between the runs of a respective middle MD yarn.

4. The press felt defined in claim 1, wherein the repeat unit includes four exterior MD yarns and two middle MD yarns.

5. The press felt defined in claim 4, wherein the repeat unit includes four CMD yarns.

6. The press felt defined in claim 4, wherein the repeat unit includes eight CMD yarns.

7. The press felt defined in claim 1, wherein the seam loops at one end are interdigitated with the seam loops at the other end, and further comprising a pin inserted into the interdigitated loops.

8. A press felt, comprising:

(a) a base fabric comprising a plurality of repeat units, each of the repeat units comprising a plurality of exterior machine direction (MD) yarns, each of which includes an upper run and a lower run merging with seam loops at each end, a plurality of middle MD yarns positioned between the upper and lower runs of the exterior MD yarns, wherein the plurality of middle MD yarns comprises half the number of the plurality of exterior MD yarns, and a plurality of cross machine direction (CMD) yarns interwoven with the exterior MD yarns and the middle MD yarns in a predetermined regular weave pattern, the seam loops defining the longitudinal ends of the press felt, wherein each of the middle MD yarns has two generally parallel runs connected by a loop, and wherein a CMD yarn nearest the seam loops interweaves with the upper and lower runs of the exterior MD yarns and with the runs of the middle MD yarns; and (b) a batt layer overlying the base fabric.

9. The press felt defined in claim 8, wherein the repeat unit includes four exterior MD yarns and two middle MD yarns.

10. The press felt defined in claim 9, wherein the repeat unit includes four CMD yarns.

11. The press felt defined in claim 9, wherein the repeat unit includes eight CMD yarns.

12. The press felt defined in claim 8, wherein the seam loops at one end are interdigitated with the seam loops at the other end, and further comprising a pin inserted into the interdigitated loops.

13. The press felt defined in claim 12, wherein the pin is not inserted into the loops formed by the middle MD yarns.

14. The press felt defined in claim 8, wherein at least one of the CMD yarns in the repeat unit interweaves between the runs of a respective middle MD yarn.

* * * * *